US005443234A

United States Patent [19]

Woods

[11] Patent Number: 5,443,234

[45] Date of Patent: Aug. 22, 1995

[54] ADJUSTABLE SHELF FOR A VERTICAL POST

[76] Inventor: David R. Woods, P.O. Box 4482, Nooksack, Wash. 98276-4482

[21] Appl. No.: 246,154

[22] Filed: May 19, 1994

[51] Int. Cl.[6] ..... A47G 29/02

[52] U.S. Cl. ..... 248/246; 248/125; 248/295.1

[58] Field of Search ..... 248/125, 246, 245, 295.1, 248/297.2; 211/187, 193

[56] References Cited

U.S. PATENT DOCUMENTS

| | | | |
|---|---|---|---|
| 744,149 | 11/1903 | Wilton | 211/193 X |
| 2,123,695 | 7/1938 | Elmer | 248/125 X |
| 3,368,784 | 2/1968 | Peterson | 248/245 |
| 4,167,255 | 9/1979 | Benson | 248/246 X |
| 4,708,309 | 11/1987 | Walter | 248/125 X |

FOREIGN PATENT DOCUMENTS

| | | | |
|---|---|---|---|
| 658105 | 5/1929 | France | 248/246 |
| 1427198 | 12/1965 | France | 248/245 |
| 164213 | 6/1921 | United Kingdom | 248/245 |

*Primary Examiner*—J. Franklin Foss
*Attorney, Agent, or Firm*—Norman B. Rainer

[57] ABSTRACT

A device for the supportive positioning of objects at different elevations along a vertical post includes a shelf member disposed upon a support arm pivotably secured to a mounting base. Post-engaging brackets are associated with the mounting base, and interact with an adjustable stop protrusion on the support arm to grip an intervening fencepost when the support arm is swung to its lowermost position.

10 Claims, 2 Drawing Sheets

ADJUSTABLE SHELF FOR A VERTICAL POST

BACKGROUND OF THE INVENTION

1. Field of the Invention

This invention concerns a shelf for the supportive positioning of objects placed thereupon, and more particularly relates to a shelf which can be adjustably positioned at different elevations upon a vertical post.

2. Description of the Prior Art

Shelves designed for holding or storing objects are generally characterized in having a flat horizontal upwardly facing surface and support means which secure the position of the shelf. Numerous shelving systems have been disclosed comprised of shelves and support means permitting adjustable mounting upon a wall at different elevations.

The adjustable positioning of trays, shelves and baskets upon a vertical support post is disclosed in U.S. Pat. Nos. 494,758; 3,414,133; 5,144,023; D324,148; D325,838; and elsewhere. Such devices either require that the post penetrates a mounting aperture in the shelf surface, or require modification of the post, or are adapted for use only on a post of a particular shape and size, or involve extensive manipulation and/or use of tools to achieve positional adjustment.

Outdoor recreational areas are often located behind private dwellings, and may be bordered at least in part by a fence or railing that affords privacy, enhances decor, or serves still other purposes. Fences are often comprised of a series of vertical posts. In such situation, it would be desirable to utilize the posts to support shelves that can hold food and beverage items, game devices, reading material, garden utensils, plants, or other things encountered in the general course of using such "backyard" areas. Other vertical post structures besides fence posts may also be found in backyards, such posts being employed for example for bird feeders, recreational equipment, floodlights, antennas and other purposes.

It is accordingly an object of the present invention to provide a shelf device supportable by a vertical post at easily adjustable elevations.

It is another object of this invention to provide a device as in the foregoing object which does not require tools or modification of said post to be supported thereby.

It is a further object of the present invention to provide a shelf device of the aforesaid nature of simple, rugged construction amenable to low cost manufacture.

These objects and other objects and advantages of the invention will be apparent from the following description.

SUMMARY OF THE INVENTION

The above and other beneficial objects and advantages are accomplished in accordance with the present invention by a shelf device which adjustably attaches to a vertical post at variable elevations, said shelf comprising:

a) a mounting base comprising a panel elongated between forward and rearward extremities and having a horizontally disposed upper abutment edge and flat interior and exterior sidewalls, b) post-engaging abutment means disposed upon said interior sidewall adjacent said rearward extremity, c) laterally adjustable gripping means interactively associated with said post-engaging abutment means, d) a support arm pivotably attached to said sidewall and bounded by front and back extremities, upper and lower border surfaces, and interior and exterior side faces, said interior side face being flat and adapted to slideably contact the interior sidewall of said mounting base, said back extremity having a vertical portion adjacent said lower border surface, and an upper portion recessed forwardly toward said front extremity, e) horizontally adjustable stop means protruding rearwardly from the vertical portion of said back extremity and positioned to press against a post intervening between said post-engaging abutment means and the back extremity of said support arm, and f) a shelf member horizontally disposed upon the upper border surface of said support arm.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
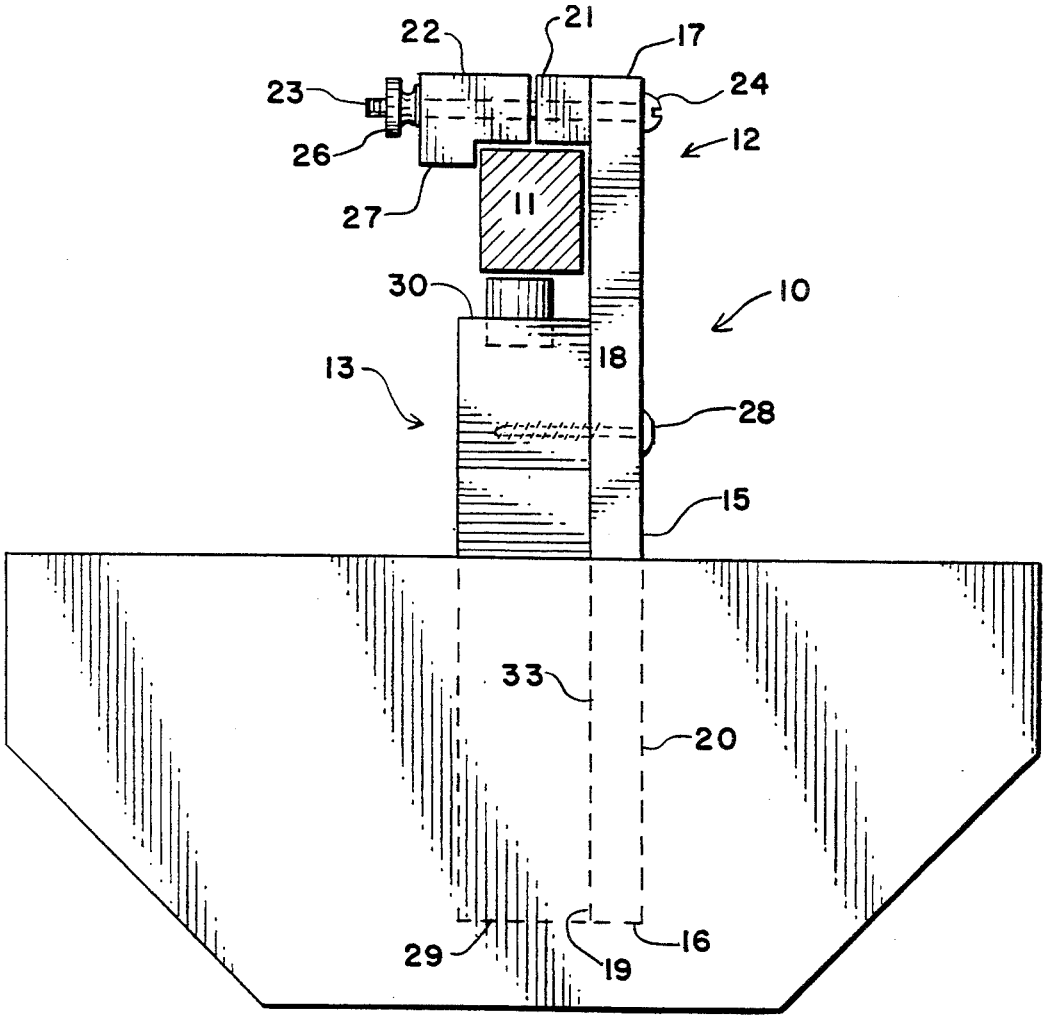
FIG. 1 is a top plan view of an embodiment of the device of this invention.

Referring to FIGS. 1–4, an embodiment of the adjustable height shelf device 10 of this invention fabricated substantially entirely of wood is shown in functional association with a vertical post 11 of rectangular contour.

The shelf device is comprised in general of a mounting base 12, a support arm 13 attached to said mounting base, and a shelf member 14 disposed upon said support arm.

Said mounting base 12 is comprised of a vertically oriented panel 15 elongated between forward and rearward extremities 16 and 17, respectively, and having a horizontally disposed upper abutment edge 18, and flat interior and exterior sidewalls, 19 and 20, respectively.

Post-engaging abutment means in the form of straight vertical rail 21 is disposed upon said interior sidewall adjacent rearward extremity 17 of said mounting base. In alternative embodiments, said post-engaging abutment means may be integral with panel 15, as when the components of the device are fabricated of plastic.

Laterally adjustable gripping means in the form of elongated bracket 22 is associated with rail 21 by way of threaded bolt 23 and paired parallel alignment rods 24 which extend horizontally from rail 21 into receiving bores 25 in bracket 22. A knurled flat-shouldered nut 26 threadably disposed upon bolt 23 enables bracket 22 to be urged toward panel 15. A forwardly disposed retaining lip 27, integral with bracket 22, is configured to press the intervening vertical post 11 against interior sidewall 19.

Support arm 13 is attached by way of pivot means in the form of screw 28 to panel 15 at a site closer to rearward extremity 17 than foreward extremity 16. Support arm 13 is bounded by front and back extremities, 29 and 30, respectively, upper and lower border surfaces 31 and 32, respectively, and interior and exterior side faces, 33 and 34, respectively. Said interior side face 33 is flat and adapted to slidably contact the interior sidewall 19 of panel 15. Back extremity 30 has a vertically oriented portion 35 adjacent lower border surface 32, and has an upper portion 36 which is recessed forwardly toward front extremity 29. Although the manner of such recess is exemplified as a straight angled or chamfered corner region, such recess may be of curvilinear or multifaceted contour. The recess may be further characterized as a deleted portion of the support arm which would otherwise be present at the intersection of a continuation of vertically oriented portion 35 and upper border surface 31.

Figure 2:
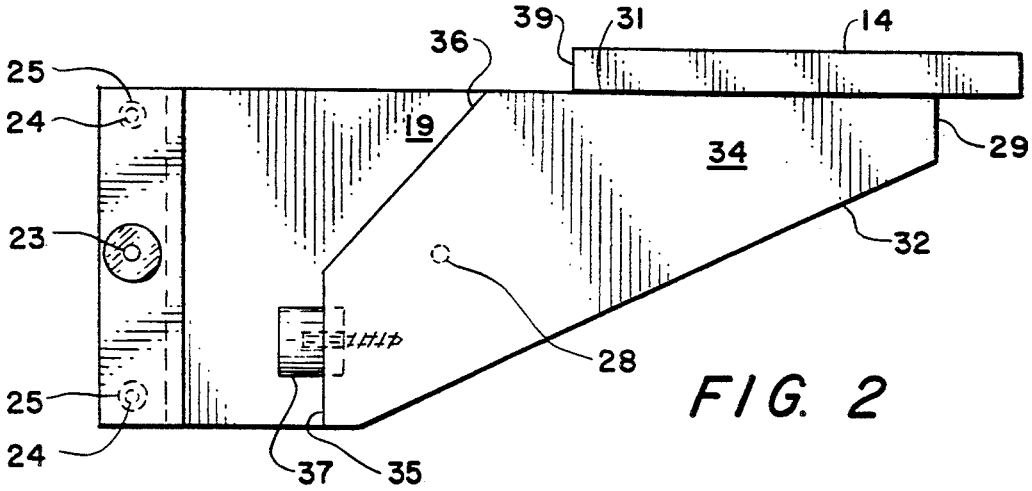
FIG. 2 is a side view taken from the left of FIG. 1.
Figure 3:
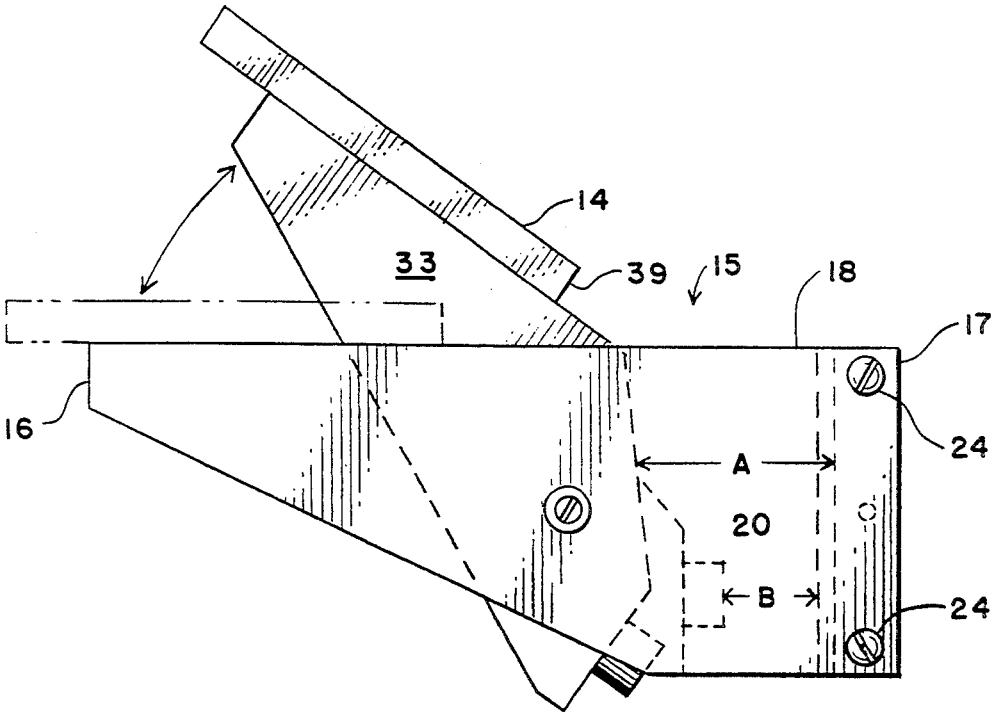
FIG. 3 is a side view taken from the right of FIG. 1, showing two positions of the shelf.
Figure 4:
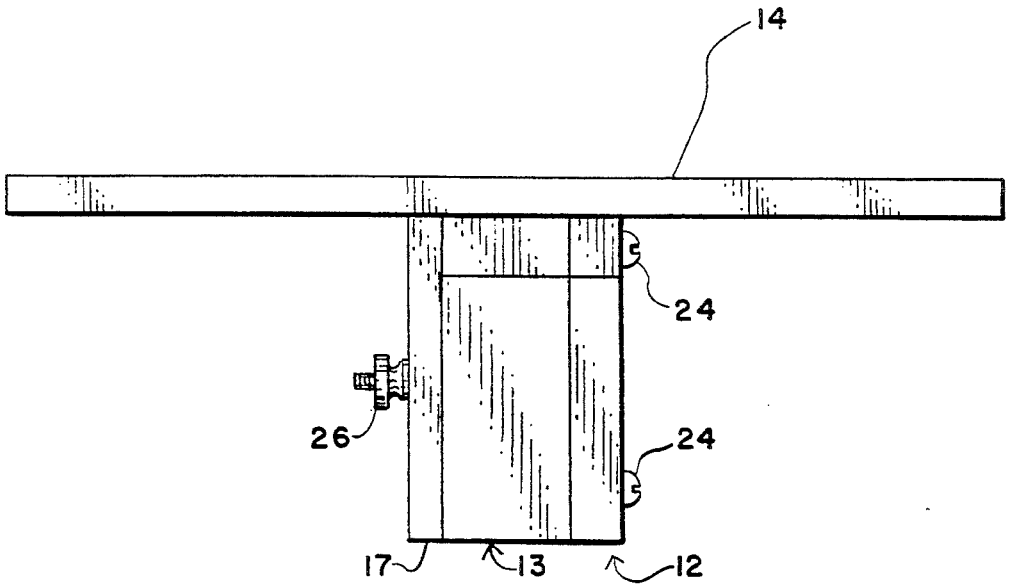
FIG. 4 is a front view of the embodiment of FIG. 1.

Horizontally adjustable stop means in the form of plug 37 protrudes rearwardly from vertically oriented portion 35 and is threadably associated with arm 13 in a manner to press against vertical post 11 when arm 13 is in its lowermost position of travel, as shown in FIGS. 1, 2 and 3.

Shelf member 14 is secured as by bolting or adhesives to the upper border surface 31 of arm 13. When the support arm is in its lowermost position of travel, the underside of shelf member 14 rests upon the upper abutment edge 18 of panel 15. Although the exemplified embodiment of the shelf member has a polygonal perimeters other configurations may be employed.

In applying the device of this invention to a vertical post, support arm 13 is raised by pivotal motion with respect to panel 15. In such position, a relatively large space, denoted by A in FIG. 3 exits between vertical abutment rail 21 and support arm 13. Such position enables the device to easily accommodate a vertical post within space A. It is to be noted that the effectiveness of space A is achievable because the rear edge 39 of shelf member 14 is forwardly displaced from upper portion 36 of back extremity 30. When support arm 13 is lowered, the space, denoted by B in FIG. 3, is smaller than space A. In fact, plug 37 contacts vertical post 11 in said lower position of said support arm. In said lower position, which represents the use position of the device wherein shelf member 14 is horizontally disposed, bracket 22 is caused to tightly engage the side of the vertical post and plug 37 engages the front of the vertical post. The dual mode of securement causes the device to be stable at any chosen elevation upon the post.

In alternative embodiments of the invention, the shelf member may be comprised of just the upper border surface 31 of said support arm. Although of narrow configuration, such embodiment may serve to support an elongated shelf extending between two of the devices of this invention positioned at the same elevation. In a still further object of this invention the shelf member, in the form of said upper border surface may be forwardly elongated and may serve to support a pendently disposed structure such as a bird feeder, flower pot, candle, wind chimes or other items of outdoor use.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A shelf device which adjustably attaches to a vertical post at variable elevations, said shelf comprising:

a) a mounting base comprising a panel elongated between forward and rearward extremities and having a horizontally disposed upper abutment edge and flat interior and exterior sidewalls, b) post-engaging abutment means disposed upon said interior sidewall adjacent said rearward extremity, c) laterally adjustable gripping means interactively associated with said post-engaging abutment means, d) a support arm pivotably attached to said sidewall and bounded by front and back extremities, upper and lower border surfaces, and interior and exterior side faces, said interior side face being flat and adapted to slideably contact the interior sidewall of said mounting base, said back extremity having a vertical portion adjacent said lower border surface, and an upper portion recessed forwardly toward said front extremity, e) horizontally adjustable stop means protruding rearwardly from the vertical portion of said back extremity and positioned to press against a post intervening between said post-engaging abutment means and the back extremity of said support arm, and f) a shelf member horizontally disposed upon the upper border surface of said support arm.

2. The device of claim 1 fabricated of wood.

3. The device of claim 1 wherein said post-engaging abutment means and laterally adjustable gripping means are configured to embrace a post of rectangular cross-sectional shape.

4. The device of claim 3 wherein said post-engaging abutment means is a straight, vertically disposed rail.

5. The device of claim 1 fabricated of plastic by way of a molding operation and wherein said post-engaging abutment means is integral with said mounting base.

6. The device of claim 1 wherein said laterally adjustable gripping means is interactively associated with said post-engaging abutment means by way of at least one threaded bolt.

7. The device of claim 6 further comprising paired parallel alignment rods which extend horizontally to interengage said post-engaging abutment means with said laterally adjustable gripping means.

8. The device of claim 1 wherein said horizontally adjustable stop means is threadably associated with said support arm.

9. The device of claim 1 wherein said support arm and the shelf member held thereby is adapted to swing in a vertical plane to an upward position.

10. The device of claim 9 so configured and dimensioned as to create in said upward position a space between said post-engaging abutment means and support arm which is larger than the space required to accommodate said post.

* * * * *